US010550649B2

(12) United States Patent
Ha et al.

(10) Patent No.: US 10,550,649 B2
(45) Date of Patent: Feb. 4, 2020

(54) DRILLING APPARATUS

(71) Applicant: SAMSUNG HEAVY INDUSTRIES CO., LTD., Seoul (KR)

(72) Inventors: Young Youl Ha, Gyeongsangnam-do (KR); Dong Gun Lee, Gyeongsangnam-do (KR); Hyun Goo Kim, Gyeongsangnam-do (KR); Sung June Bae, Gyeongsangnam-do (KR)

(73) Assignee: SAMSUNG HEAVY INDUSTRIES CO., LTD., Seoul (KR)

( * ) Notice: Subject to any disclaimer, the term of this patent is extended or adjusted under 35 U.S.C. 154(b) by 157 days.

(21) Appl. No.: 15/757,310

(22) PCT Filed: Aug. 31, 2016

(86) PCT No.: PCT/KR2016/009707
§ 371 (c)(1),
(2) Date: Mar. 2, 2018

(87) PCT Pub. No.: WO2017/039305
PCT Pub. Date: Mar. 9, 2017

(65) Prior Publication Data

US 2018/0258713 A1 Sep. 13, 2018

(30) Foreign Application Priority Data

Sep. 3, 2015 (KR) ..... 10-2015-0124704

(51) Int. Cl.
*E21B 19/00* (2006.01)
*B66D 3/08* (2006.01)
(Continued)

(52) U.S. Cl.
CPC ..... *E21B 19/008* (2013.01); *B66D 1/26* (2013.01); *B66D 1/485* (2013.01); *B66D 1/525* (2013.01);
(Continued)

(58) Field of Classification Search
CPC ..... E21B 19/008; E21B 19/006; E21B 19/02; E21B 19/00; B66D 1/26; B66D 3/08;
(Continued)

(56) References Cited

U.S. PATENT DOCUMENTS 5,114,026 A * 5/1992 Van Ketel ..... B66D 1/52 212/308
6,595,494 B1 * 7/2003 Roodenburg ..... B66C 13/02 254/277
(Continued)

FOREIGN PATENT DOCUMENTS

KR 20110026057 A 3/2011
KR 20110029965 A 3/2011
(Continued)

OTHER PUBLICATIONS

World Intellectual Property Organization, International Search Report for international application No. PCT/KR2016/009707, dated Nov. 25, 2016, 2 total pages.

*Primary Examiner* — Michael R Mansen
*Assistant Examiner* — Nathaniel L Adams
(74) *Attorney, Agent, or Firm* — SoCal IP Law Group LLP; Mark A. Goldstein

(57) ABSTRACT

A drilling apparatus is provided. The drilling apparatus according to one aspect of the present invention comprises: first and second moving modules; first to third drawworks for vertically moving the first and second moving modules; a wire for successively connecting the first drawwork, the first moving module, the second drawwork, the second moving module and the third drawwork; a first fixing drum positioned between the first drawwork and the first moving module so as to support the wire; and a second fixing drum positioned between the second moving module and the third drawwork so as to support the wire.

6 Claims, 8 Drawing Sheets

(51) Int. Cl.

| | |
|---|---|
| ***B66D 1/52*** | (2006.01) |
| ***B66D 1/48*** | (2006.01) |
| ***B66D 1/26*** | (2006.01) |
| *B63B 35/44* | (2006.01) |

(52) U.S. Cl.
CPC ..... *B66D 3/08* (2013.01); *E21B 19/006* (2013.01); *B63B 35/44* (2013.01)

(58) Field of Classification Search
CPC ..... B66D 1/525; B66D 1/485; B63B 35/44; B63B 27/00
See application file for complete search history.

(56) References Cited

U.S. PATENT DOCUMENTS

| | | | | |
|---|---|---|---|---|
| 7,134,645 | B1 * | 11/2006 | Johnson | B66D 1/741 254/338 |
| 8,997,888 | B2 * | 4/2015 | Roodenburg | B66C 13/02 166/355 |
| 2010/0294568 | A1 | 11/2010 | Taraldrud | |
| 2017/0341717 | A1 * | 11/2017 | Roodenburg | B63B 35/4413 |

FOREIGN PATENT DOCUMENTS

| | | | |
|---|---|---|---|
| KR | 20120059820 | A | 6/2012 |
| KR | 20150081130 | A | 7/2015 |
| WO | 2017039305 | A1 | 3/2017 |

* cited by examiner

DRILLING APPARATUS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from International PCT Patent Application No. PCT/KR2016/009707, filed Aug. 31, 2016 entitled, "DRILLING APPARATUS", which claims priority to Korean Patent Application No. 10-2015-0124704, filed Sep. 3, 2015 all of which are incorporated herein by reference in their entirety.

BACKGROUND

Technical Field

The present invention relates to a drilling apparatus, and more particularly, a drilling apparatus for collecting resources from a gas or oil well located in a seabed.

Background Art

With rapid international industrialization and developments in industries, the use of earth resources such as petroleum has gradually increased, and the stable production and supply of crude oil has become a very important issue worldwide.

For this reason, the development of marginal or deep-sea oil fields, which has been neglected due to lack of economic efficiency, has recently become economical. Therefore, along with the development of submarine mining technology, floating drilling facilities, provided with drilling equipment suitable for the development of such oilfields, have been developed.

In order to obtain gas or crude oil from a submerged gas or oil well, it is necessary to drill holes extending to the gas or oil well.

Drilling ships or drill ships have traveling modules to lift up and down pipes.

PRIOR ART LITERATURE

Korean Patent No. KR 10-2011-0029965 (2011.03.23)

DISCLOSURE

Technical Problems

To address the aforementioned problems, exemplary embodiments of the present invention provide a drilling apparatus capable of reducing the initial investment cost.

Additional advantages, subjects, and features of the invention will be set forth in part in the description which follows and in part will become apparent to those having ordinary skill in the art upon examination of the following or may be learned from practice of the invention.

Technical Solutions

According to an aspect of the present invention, a drilling apparatus includes: first and second moving modules; first through third drawworks for vertically moving the first and second moving modules; a wire for successively connecting the first drawwork, the first moving module, the second drawwork, the second moving module, and the third drawwork; a first fixing drum positioned between the first drawwork and the first moving module so as to support the wire; and a second fixing drum positioned between the second moving module and the third drawwork so as to support the wire.

The drilling apparatus may further include a controller for controlling an angular velocity of at least one of the first through third drawworks based on a weight of the first or second moving module.

If the weight of the first moving module is larger than the weight of the second moving module, the controller may determine the angular velocities of the first and second drawworks based on the weight of the first moving module and may determine the angular velocity of the third drawwork based on the weight of the second moving module and the angular velocity of the second drawwork. If the weight of the second moving module is larger than the weight of the first moving module, the controller may determine the angular velocities of the second and third drawworks based on the weight of the second moving module and may determine the angular velocity of the first drawwork based on the weight of the first moving module and the angular velocity of the second drawwork.

The drilling apparatus may further include a first compensator positioned between the first drawwork and the first fixing drum and correcting the vertical heave of the first moving module; and a second compensator positioned between the second fixing drum and the third drawwork and correcting the vertical heave of the second moving module.

An angle that the first and third drawworks form with each other with respect to the second drawwork may be less than a straight angle.

Other features and exemplary embodiments may be apparent from the following detailed description, the drawings, and the claims.

Advantageous Effects

The aforementioned and other exemplary embodiments of the present invention can provide the following benefits.

According to the present invention, an initial investment cost can be reduced.

DETAILED DESCRIPTION

Description of Apparatus

Figure 1:
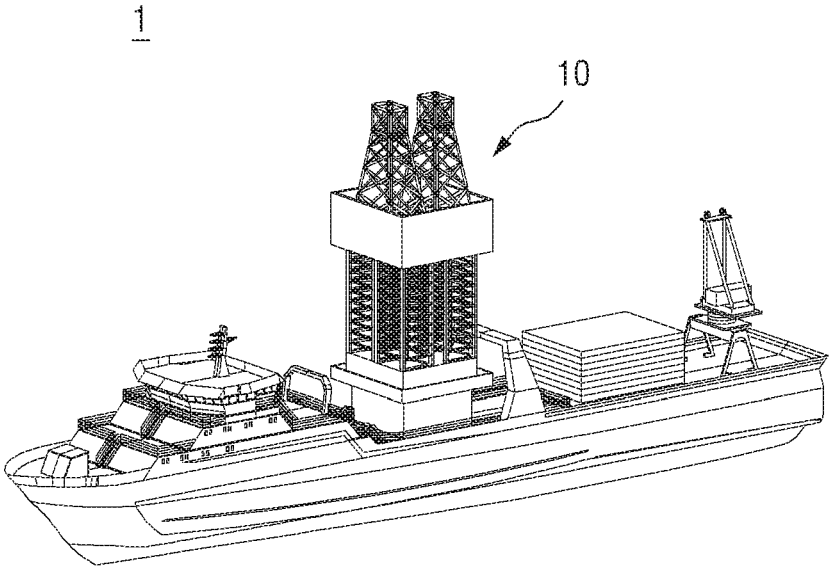
FIG. 1 is a schematic view illustrating an offshore structure according to an exemplary embodiment of the present invention.

Advantages and features of the present disclosure and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the present invention to those skilled in the art, and the present invention will only be defined within the scope of the appended claims. In the drawings, like reference numerals indicate like elements.

It will be understood that when an element or layer is referred to as being "on" or "above" another element or layer, it can be directly on above the other element or layer or intervening elements or layers may be present. In contrast, when an element is referred to as being "directly on" or "directly above" another element or layer, there are no intervening elements or layers present.

Spatially relative terms, such as "beneath", "below", "lower", "above", "upper" and the like, may be used herein for ease of description to describe one element or feature's relationship to another element(s) or feature(s) as illustrated in the drawings. It will be understood that the spatially relative terms are intended to encompass different orientations of the device in use or operation in addition to the orientation depicted in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented and the spatially relative descriptors used herein interpreted accordingly.

It will be understood that when an element or layer is referred to as being "connected to" or "coupled to" another element or layer, it can be connected or coupled to the other element or layer or intervening elements or layers may be present. In contrast, when an element is referred to as being "directly connected to" or "directly coupled to" another element or layer, there are no intervening elements or layers present. Like numbers refer to like elements throughout. As used herein, the term "and/or" includes any and all combinations of one or more of the associated listed items. As used herein, the expression "A or B" means A or B or both.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments of the present invention will hereinafter be described with reference to the accompanying drawings. In the drawings, like reference numerals are allocated to like elements, and thus, detailed descriptions thereof will be omitted.

The present invention will hereinafter be described in detail with reference to the accompanying drawings.

FIG. 1 is a schematic view illustrating an offshore structure according to an exemplary embodiment of the present invention.

Referring to FIG. 1, an offshore structure 1 includes a drilling derrick 10 on which drilling equipment is mounted. Specifically, pipes mounted on the offshore structure are transported to the drilling derrick 10 via lifting means, and a drilling apparatus installed on the drilling derrick 10 performs a drilling operation using the transported pipes. The drilling derrick 10 may form a truss structure through the assembly of linear members and inclined members and may be installed vertically on the moon pool of the offshore structure.

In exemplary embodiments of the present invention, the term "offshore structure" collectively refers to jack-up drilling rigs, jack-up rigs, drill ships, barges, marine work lines, and marine plants, and encompasses not only ships with a self-propelling capability, but also all structures installed in the ocean.

Figure 2:
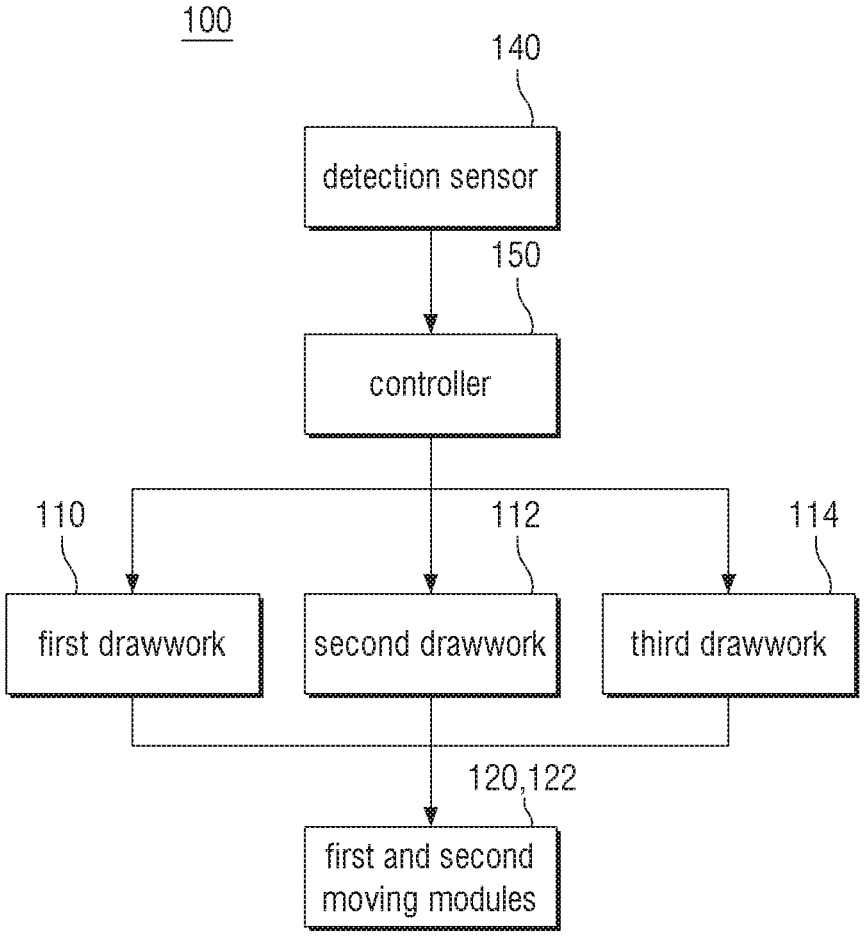
FIG. 2 is a block diagram of a drilling apparatus according to an exemplary embodiment of the present invention.

FIG. 2 is a block diagram of a drilling apparatus according to an exemplary embodiment of the present invention.

Referring to FIG. 2, a drilling apparatus 100 includes first and second moving modules 120 and 122, first, second, and third drawworks 110, 112, and 114, a detection sensor 140, and a controller 150, but does not exclude any additional elements.

The first and second moving modules 120 and 122 are installed in the drilling derrick 10 and perform a drilling operation by mounting the transported pipes and lifting them up and down. Each of the first and second moving modules 120 and 122 includes a connection mechanism. At least one of the first and second moving modules 120 and 122 may be equipped with a top drive and may thus perform various operations. For example, the first and second moving modules 120 and 122 may be configured to grasp the pipes to lift them up and down, and may allow a drill string to be formed by the assembly of the pipes.

The first, second, and third drawworks 110, 112, and 114 pull or unwind a wire 102 (see FIG. 3) connected to the first and second moving modules 120 and 122 to lift up and down the first and second moving modules 120 and 122. The rotational directions and the angular velocities of the first, second, and third drawworks 110, 112, and 114 may be controlled by the controller 150, which will be described later. The first, second, and third drawworks 110, 112, and 114 may be formed in a pulley shape to wind or unwind the wire 102, but the present invention is not limited thereto. The first, second, and third drawworks 110, 112, and 114 may be modified in various manners.

The detection sensor 140 senses the weights of the first and second moving modules 120 and 122 and transmits the sensed weights of the first and second moving modules 120 and 122 to the controller 150. The detection sensor 140 may include any type of sensor that is applicable by a person skilled in the art as long as the sensor can sense the weights of the first and second moving modules 120 and 122.

The controller 150 controls the angular velocities of the first, second, and third drawworks 110, 112, and 114 based on the sensed weights of the first and second moving modules 120 and 122. Specifically, the ascending or descending speed of each of the second moving modules 120 and 122 may be controlled by controlling the rotational direction and the angular velocity of each of the first, second, and third drawworks 110, 112, and 114 based on the sensed weights of the first and second moving modules 120 and 122.

Figure 3:
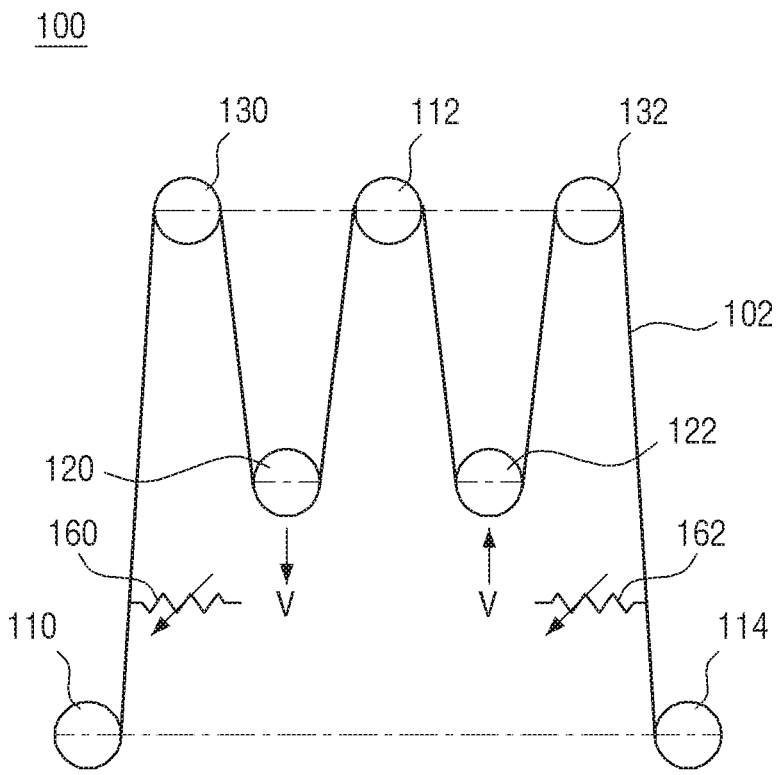
FIG. 3 is a schematic view illustrating the drilling apparatus according to an exemplary embodiment of the present invention.

FIG. 3 is a schematic view illustrating the drilling apparatus according to an exemplary embodiment of the present invention.

Specifically, referring to FIG. 3, one end of the wire 102 is connected to the first drawwork 110, the wire 102 sequentially passes by a first fixing drum 130, the first moving module 120, the second drawwork 112, the second moving module 122, and a second fixing drum 132, and the other end of the wire 102 is connected to the third drawwork 114. Thus, the first and second moving modules 120 and 122 may be lifted up or down in accordance with the operations (for example, rotational directions and angular velocities) of the first, second, and third drawworks 110, 112, and 114. However, the detailed path of the wire 102, which is connected between the first, second, and third drawworks 110, 112, and 114 and the first and second moving modules 120 and 122, may vary as long as the wire 102 can lift up or down each of the first and second moving modules 120 and 122.

It is assumed that the first and second moving modules 120 and 122 have the same weight and descend and ascend, respectively, at a constant speed V. In order to allow the first and second moving modules 120 and 122 to descend and ascend, respectively, at the constant speed V, the first drawwork 110 rotates clockwise at the constant speed V, the second drawwork 112 rotates counterclockwise at the constant speed V, and the third drawwork 114 rotates clockwise at the constant speed V. A portion of the wire 102 supporting the first moving module 120 supports half the weight of the first moving module 120, i.e., F/2, and a portion of the wire 102 supporting the second moving module 122 supports half the weight of the second moving module 122, i.e., F/2. Thus, each of the first, second, and third drawworks 110, 112, and 114 supports half the weight of the first moving module 120 or the second moving module 122, i.e., F/2. Accordingly, the output of each of the first, second, and third drawworks 110, 112, and 114 becomes F*V/2, and as a result, the total output of the drilling apparatus 100 including the three drawworks 110, 112, and 114 becomes 1.5*F*V. In other words, in order to lift up or down the first and second moving modules 120 and 122, an output lower than 2*F*V is needed, and thus, the initial investment cost can be reduced.

The drilling apparatus 100 may further include first and second compensators 160 and 162, which correct the vertical heave of the first and second moving modules 120 and 122. The first and second compensators 160 and 162 may be designed to minimize the vertical heave of the offshore structure 1 that moves in accordance with the sea conditions.

FIGS. 4 through 9 are schematic views illustrating the operation of the drilling apparatus according to an exemplary embodiment of the present invention.

A case where the drilling apparatus 100 performs tripping in, drilling, or casing running will hereinafter be described with reference to FIGS. 4 through 6.

Figure 4:
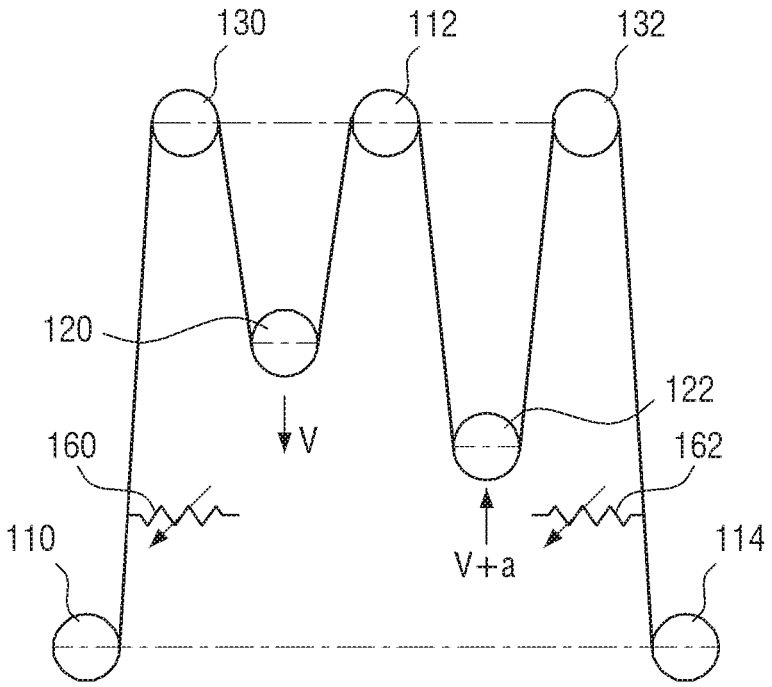
FIGS. 4 through 9 are schematic views illustrating the operation of the drilling apparatus according to an exemplary embodiment of the present invention.
Figure 6:
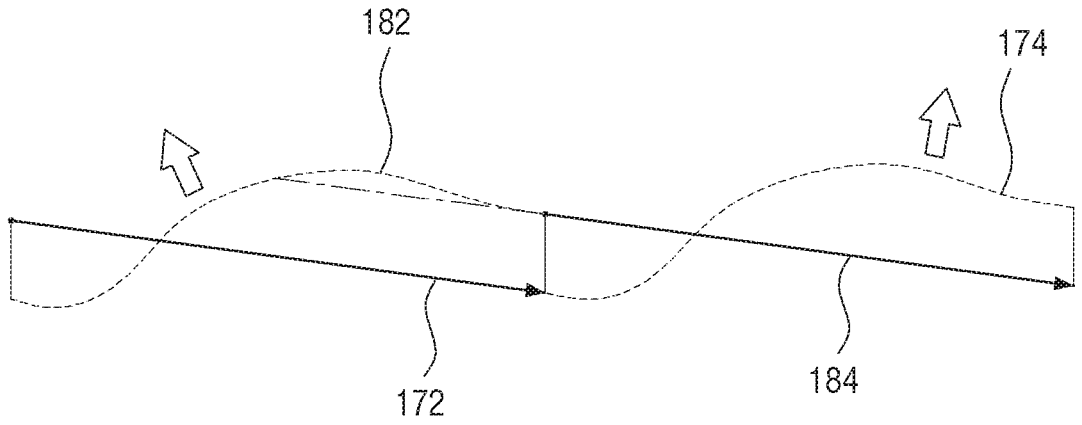

Referring to FIGS. 4 and 6, the first moving module 120 prepares a work by grasping a pipe in an elevated state, and the second moving module 122 completes its work in a lowered state. Since the first moving module 120 holds the pipe, the weight of the first moving module 120 is larger than the weight of the second moving module 122. The controller 150 controls the rotational directions and/or the angular velocities of the first and second drawworks 110 and 112 based on the weight of the first moving module 120, measured by the detection sensor 140. Thereafter, the controller 150 controls the rotation direction and/or angular velocity of the third drawwork 114 based on the weight of the second moving module 122, measured by the detection sensor 140, and the angular velocity of the second drawwork 112. Since the rotational directions and/or angular velocities of the first and second drawworks 110 and 112 are determined first based on the first moving module 120, which is heavy, the control operation of the controller 150 can be reduced. Also, since the second moving module 122, which is lightweight, can be quickly lifted up, a subsequent work can be promptly prepared by the second moving module 122 that is quickly raised. In other words, the first moving module 120 descends at the constant speed V along a first moving path 172, and the second moving module 122 can ascend at a higher speed than the constant speed V along a second moving path 182.

Figure 5:
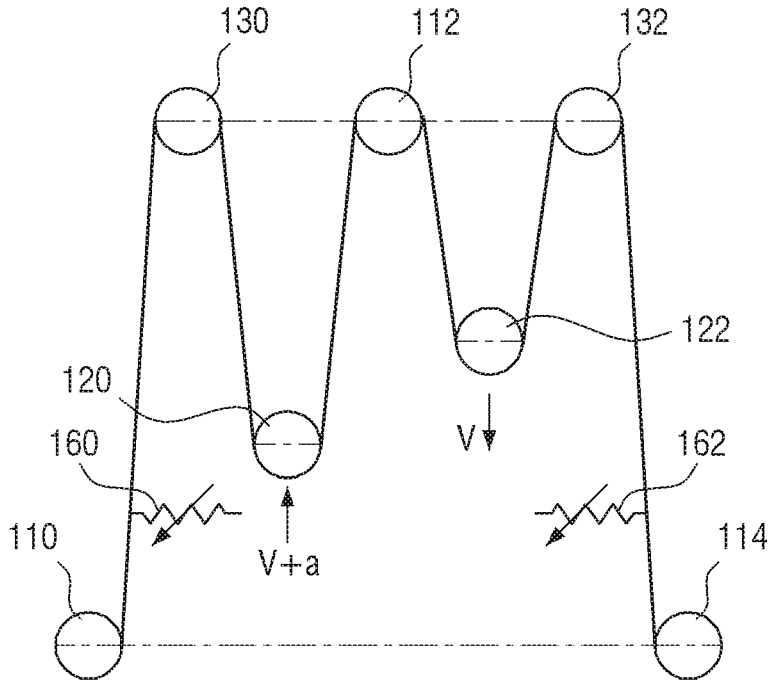

Referring to FIGS. 5 and 6, the first moving module 120 completes its work in a lowered state, and the second moving module 122 prepares a subsequent work by grasping a pipe in an elevated state. Since the second moving module 122 holds the pipe, the weight of the second moving module 122 is larger than the weight of the first moving module 120. The controller 150 controls the rotational directions and/or the angular velocities of the second and third drawworks 112 and 114 based on the weight of the second moving module 122, measured by the detection sensor 140. Thereafter, the controller 150 controls the rotation direction and/or angular velocity of the first drawwork 114 based on the weight of the first moving module 120, measured by the detection sensor 140, and the angular velocity of the second drawwork 112. Since the rotational directions and/or angular velocities of the second and third drawworks 112 and 114 are determined first based on the second moving module 122, which is heavy, the control operation of the controller 150 can be reduced. Also, since the first moving module 120, which is lightweight, can be quickly lifted up, the subsequent work can be promptly prepared by the first moving module 120 that is quickly raised. In other words, the second moving module 122 descends at the constant speed V along a third moving path 184, and the first moving module 120 can ascend at a higher speed than the constant speed V along a fourth moving path 174.

A case where the drilling apparatus 100 performs tripping out or reaming will hereinafter be described with reference to FIGS. 7 through 9.

Figure 7:
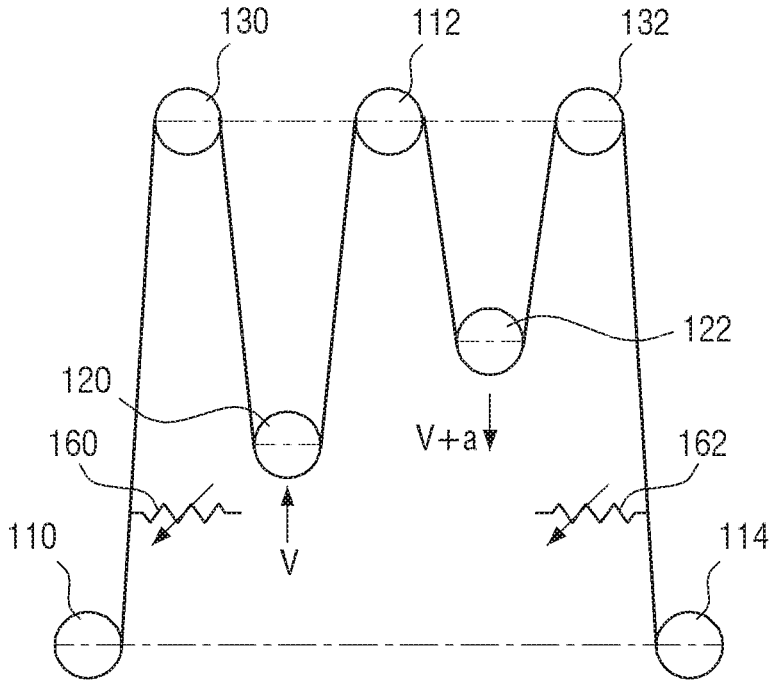
Figure 9:
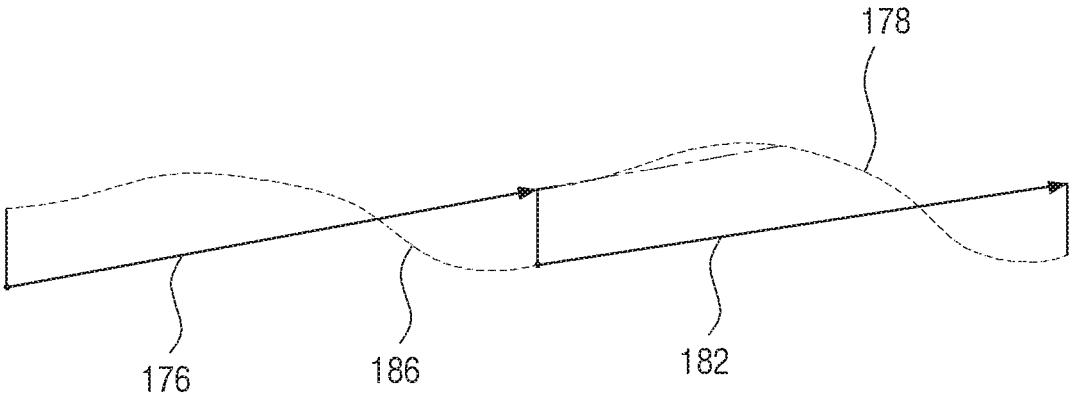

Referring to FIGS. 7 and 9, the first moving module 120 prepares an elevation work by grasping a pipe in a lowered state, and the second moving module 122 completes its work by separating a pipe in an elevated state. Since the first moving module 120 holds the pipe, the weight of the first moving module 120 is larger than the weight of the second moving module 122. The controller 150 controls the rotational directions and/or the angular velocities of the first and second drawworks 110 and 112 based on the weight of the first moving module 120, measured by the detection sensor 140. Thereafter, the controller 150 controls the rotation direction and/or angular velocity of the third drawwork 114 based on the weight of the second moving module 122, measured by the detection sensor 140, and the angular velocity of the second drawwork 112. Since the rotational directions and/or angular velocities of the first and second drawworks 110 and 112 are determined first based on the first moving module 120, which is heavy, the control operation of the controller 150 can be reduced. Also, since the second moving module 122, which is lightweight, can be quickly lifted down, a subsequent work can be promptly prepared by the second moving module 122 that is quickly lowered. In other words, the first moving module 120 ascends at the constant speed V along a fifth moving path 176, and the second moving module 122 can descend at a higher speed than the constant speed V along a sixth moving path 186.

Figure 8:
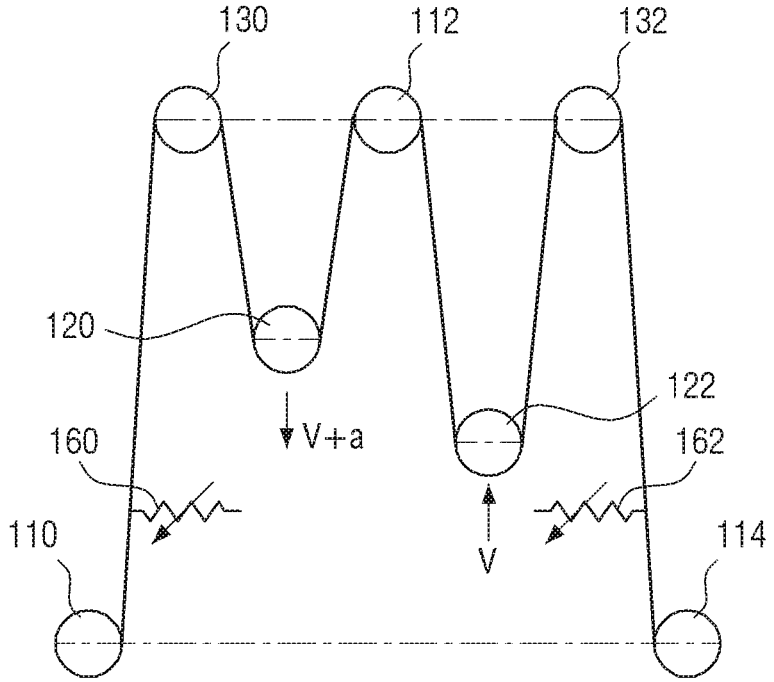

Referring to FIGS. 8 and 9, the second moving module 122 prepares an elevation work by grasping a pipe in a lowered state, and the first moving module 120 completes its work by separating a pipe in an elevated state. Since the second moving module 122 holds the pipe, the weight of the second moving module 122 is larger than the weight of the first moving module 120. The controller 150 controls the rotational directions and/or the angular velocities of the second and third drawworks 112 and 114 based on the weight of the second moving module 122, measured by the detection sensor 140. Thereafter, the controller 150 controls the rotation direction and/or angular velocity of the first drawwork 110 based on the weight of the first moving module 120, measured by the detection sensor 140, and the angular velocity of the second drawwork 112. Since the rotational directions and/or angular velocities of the second and third drawworks 112 and 114 are determined first based on the second moving module 122, which is heavy, the control operation of the controller 150 can be reduced. Also, since the first moving module 120, which is lightweight, can be quickly lifted down, a subsequent work can be promptly prepared by the first moving module 120 that is quickly lowered. In other words, the second moving module 122 ascends at the constant speed V along a seventh moving path 188, and the first moving module 120 can descend at a higher speed than the constant speed V along an eighth moving path 178.

Figure 10:
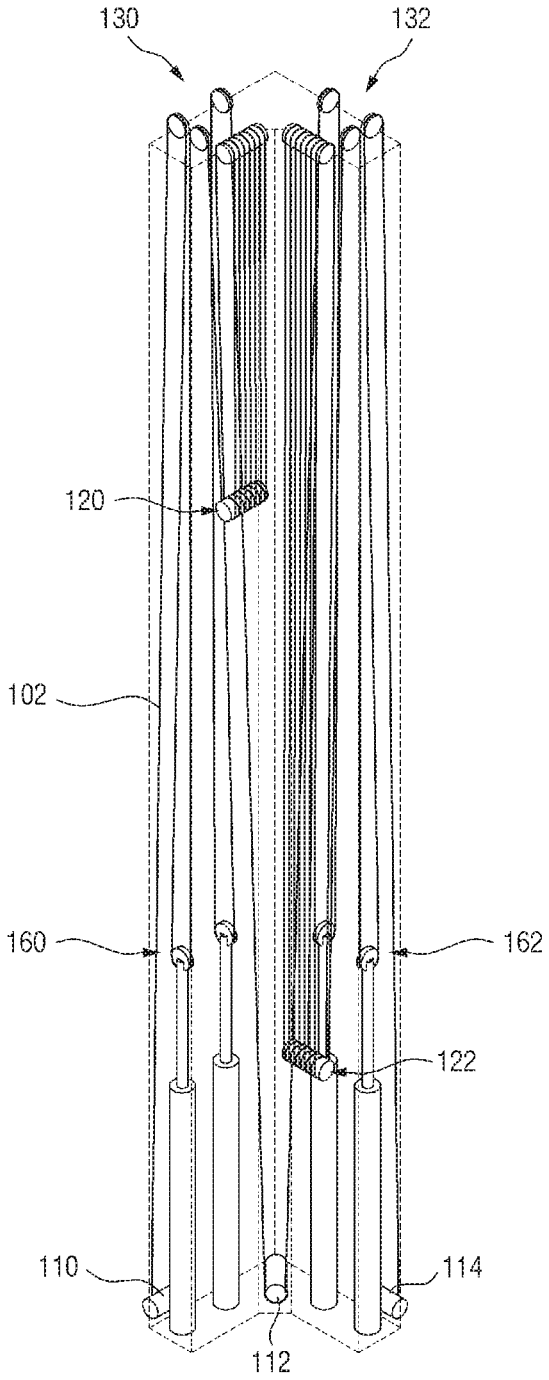
FIG. 10 is a perspective view of the drilling apparatus according to an exemplary embodiment of the present invention.

FIG. 10 is a perspective view of the drilling apparatus according to an exemplary embodiment of the present invention.

Referring to FIG. 10, the drilling apparatus 100 may be designed in such a manner that the angle that the first and third drawworks 110 and 114 form with each other with respect to the second drawwork 112 can be less than a straight angle. In other words, since the first, second, and third drawworks 110, 112, and 114 do not fall on a straight line, space efficiency can be improved. However, the angle that the first and third drawworks 110 and 114 form with each other with respect to the second drawwork 112 is not particularly limited, but may vary as long as space efficiency can be improved.

The controller 150 of the drilling apparatus 100 has been described above as controlling the rotational directions and the angular velocities of the first, second, and third drawworks 110, 112, and 114 based on the weights of the moving modules 120 and 122, which, however, is merely an example of controlling the heights of the first and second moving modules 120 and 122. Various methods such as optimum designs for maximum speed specifications based on the output of the first, second, and third drawworks 110, 112, and 114 are applicable to the present invention.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

DESCRIPTION OF REFERENCE NUMERALS

1: Offshore Structure
2: Drilling Derrick
100: Drilling Apparatus
102: Wire
110, 112, 114: Drawworks
120, 122: Traveling Modules
130, 132: Fixing Drums
140: Detection Sensor
150: Controller
160, 162: Compensators It is claimed:

1. A drilling apparatus comprising:
first and second moving modules;
first through third drawworks for vertically moving the first and second moving modules;
a wire for successively connecting the first drawwork, the first moving module, the second drawwork, the second moving module, and the third drawwork;
a first fixing drum positioned between the first drawwork and the first moving module so as to support the wire; and
a second fixing drum positioned between the second moving module and the third drawwork so as to support the wire.

2. The drilling apparatus of claim 1, further comprising:
a controller for controlling an angular velocity of at least one of the first through third drawworks based on a weight of the first or second moving module.

3. The drilling apparatus of claim 2, wherein if the weight of the first moving module is larger than the weight of the second moving module, the controller determines the angular velocities of the first and second drawworks based on the weight of the first moving module and determines the angular velocity of the third drawwork based on the weight of the second moving module and the angular velocity of the second drawwork.

4. The drilling apparatus of claim 2, wherein if the weight of the second moving module is larger than the weight of the first moving module, the controller determines the angular velocities of the second and third drawworks based on the weight of the second moving module and determines the angular velocity of the first drawwork based on the weight of the first moving module and the angular velocity of the second drawwork.

5. The drilling apparatus of claim 1, further comprising:
a first compensator positioned between the first drawwork and the first fixing drum and correcting the vertical heave of the first moving module; and a second compensator positioned between the second fixing drum and the third drawwork and correcting the vertical heave of the second moving module.

6. The drilling apparatus of claim 1, wherein an angle that the first and third drawworks form with each other with respect to the second drawwork is less than a straight angle.

* * * * *